US011232901B2

(12) United States Patent
Makino et al.

(10) Patent No.: US 11,232,901 B2
(45) Date of Patent: Jan. 25, 2022

(54) METHOD FOR PRODUCING LAMINATED MAGNETIC CORE

(71) Applicants: TOHOKU MAGNET INSTITUTE CO., LTD., Sendai (JP); PANASONIC CORPORATION, Kadoma (JP)

(72) Inventors: Akihiro Makino, Sendai (JP); Nobuyuki Nishiyama, Sendai (JP); Kana Takenaka, Sendai (JP); Yukio Nishikawa, Kadoma (JP); Terutsugu Segawa, Kadoma (JP)

(73) Assignees: TOHOKU MAGNET INSTITUTE CO., LTD., Miyagi (JP); PANASONIC CORPORATION, Osaka (JP)

( * ) Notice: Subject to any disclaimer, the term of this patent is extended or adjusted under 35 U.S.C. 154(b) by 316 days.

(21) Appl. No.: 15/738,710

(22) PCT Filed: Jul. 1, 2016

(86) PCT No.: PCT/JP2016/069674
§ 371 (c)(1),
(2) Date: Dec. 21, 2017

(87) PCT Pub. No.: WO2017/006868
PCT Pub. Date: Jan. 12, 2017

(65) Prior Publication Data

US 2018/0166213 A1 Jun. 14, 2018

(30) Foreign Application Priority Data

Jul. 3, 2015 (JP) ..... JP2015-134309

(51) Int. Cl.
*H01F 41/02* (2006.01)
*C21D 6/00* (2006.01)
(Continued)

(52) U.S. Cl.
CPC ..... *H01F 41/0206* (2013.01); *C21D 1/26* (2013.01); *C21D 6/00* (2013.01); *C21D 9/52* (2013.01);
(Continued)

(58) Field of Classification Search
CPC . C22C 45/02; H01F 41/0206; H01F 41/0213; H01F 41/0226; H01F 41/0233;
(Continued)

(56) References Cited

U.S. PATENT DOCUMENTS 3,569,886 A * 3/1971 Specht ..... H01F 27/245 336/217
6,132,891 A * 10/2000 Kumura ..... H01F 1/15316 148/304
(Continued)

FOREIGN PATENT DOCUMENTS

CN 1234905 A 11/1999
CN 101030468 A 9/2007
(Continued)

OTHER PUBLICATIONS

Japanese Office Action (and English language translation thereof) dated May 30, 2018 issued in counterpart Japanese Application No. 2017-527427.
(Continued)

*Primary Examiner* — A. Dexter Tugbang
(74) *Attorney, Agent, or Firm* — Holtz, Holtz & Volek PC

(57) ABSTRACT

A method for producing a magnetic core includes a processing step of giving a desired shape to a strip made of an alloy composition, a heat-treating step of forming bcc-Fe crystals, and then a stacking step of obtaining a magnetic core having a shape. Here, the alloy composition is Fe—B—Si—P—Cu—C and has an amorphous phase as a primary phase. In the heat-treating step, the strip is heated up to a temperature
(Continued)

higher than a crystallization temperature of the alloy composition at a high heating rate.

22 Claims, 5 Drawing Sheets

(51) Int. Cl.

| | |
|---|---|
| ***C21D 9/52*** | (2006.01) |
| ***C21D 1/26*** | (2006.01) |
| ***H01F 27/25*** | (2006.01) |
| ***H01F 3/04*** | (2006.01) |
| ***H01F 1/153*** | (2006.01) |
| ***C22C 45/02*** | (2006.01) |
| ***H01F 1/147*** | (2006.01) |
| ***H01F 27/245*** | (2006.01) |

(52) U.S. Cl.
CPC ..... *C22C 45/02* (2013.01); *H01F 1/147* (2013.01); *H01F 1/15308* (2013.01); *H01F 1/15333* (2013.01); *H01F 3/04* (2013.01); *H01F 27/245* (2013.01); *H01F 27/25* (2013.01); *H01F 41/0213* (2013.01); *H01F 41/0226* (2013.01); *H01F 41/0233* (2013.01); *C21D 2201/03* (2013.01); *H01F 1/15316* (2013.01); *H01F 1/15325* (2013.01)

(58) Field of Classification Search
CPC .. H01F 1/147; H01F 1/15308; H01F 1/15316; H01F 1/15325; H01F 1/15333; H01F 3/04; H01F 27/245; H01F 27/25; C21D 1/26; C21D 6/00; C21D 9/52; C21D 2201/03
See application file for complete search history.

(56) References Cited

U.S. PATENT DOCUMENTS

| | | | | |
|---|---|---|---|---|
| 6,287,391 | B1 | 9/2001 | Kanekiyo et al. | |
| 8,491,731 | B2 | 7/2013 | Makino | |
| 2007/0109086 | A1* | 5/2007 | Rybak | H01F 41/0213 336/180 |
| 2007/0181219 | A1* | 8/2007 | Shimada | C22C 45/02 148/101 |
| 2010/0040503 | A1* | 2/2010 | Yoshizawa | C22C 45/02 420/82 |
| 2010/0084056 | A1 | 4/2010 | Ohta et al. | |
| 2010/0139814 | A1* | 6/2010 | Makino | C22C 45/02 148/403 |
| 2013/0088314 | A1 | 4/2013 | Francoeur et al. | |
| 2013/0139929 | A1 | 6/2013 | Francoeur et al. | |
| 2013/0278366 | A1 | 10/2013 | Makino | |
| 2014/0152416 | A1 | 6/2014 | Herzer et al. | |
| 2016/0086712 | A1 | 3/2016 | Couture et al. | |
| 2017/0096721 | A1 | 4/2017 | Francoeur et al. | |
| 2018/0108465 | A1* | 4/2018 | Takahashi | C22C 45/02 |

FOREIGN PATENT DOCUMENTS

| | | | | |
|---|---|---|---|---|
| JP | 2001057306 | A | | 2/2001 |
| JP | 2003213331 | A | | 7/2003 |
| JP | 2010109001 | A | * | 5/2010 |
| JP | 2010150665 | A | | 7/2010 |
| JP | 2011256453 | A | | 12/2011 |
| JP | 2012174824 | A | | 9/2012 |
| JP | 2013046032 | A | | 3/2013 |
| JP | 2013511617 | A | | 4/2013 |
| JP | 2014240516 | A | | 12/2014 |
| JP | 2015090892 | A | | 5/2015 |
| JP | 2015095500 | A | | 5/2015 |
| WO | 2008133301 | A1 | | 11/2008 |
| WO | 2008133302 | A1 | | 11/2008 |

OTHER PUBLICATIONS

International Search Report (ISR) dated Sep. 13, 2016 issued in International Application No. PCT/JP2016/069674.
Written Opinion dated Sep. 13, 2016 issued in International Application No. PCT/JP2016/069674.
Japanese Office Action dated Dec. 11, 2019 (and English translation thereof) issued in Japanese Application No. 2018221191.
Chinese Office Action dated Aug. 12, 2019 (and English translation thereof) issued in Chinese Application No. 201680037664.2.
Yubao, et al., "Research and Application of Nano Materials", University of Electronic Science and Technology of China Press; Jan. 2005; p. 103.
Chinese Office Action dated Jan. 7, 2020 issued in counterpart Chinese Application No. 201680037664.2.
Japanese Office Action (and English language translation thereof) dated Aug. 22, 2018 issued in counterpart Japanese Application No. 2017-527427.
Harakawa, et al., "Preparation of Flaky Amorphous Powders", Journal of the Japan Society of Colour Material, Japan, Japan Society of Colour Material, Dec. 20, 1994, vol. 67, No. 12, pp. 817-822.
Chinese Office Action (and English language translation thereof) dated Feb. 25, 2019 issued in counterpart Chinese Application No. 201680037664.2.
Liu, et al., "Study on Amorphous Nanocrystalline Alloys and Thier Magnetic Properties", China University of Mining and Technology Press, Nov. 30, 2009, 178-179.
Qin, "Repair of Clock", Shanghai Science and Technology Press, Oct. 30, 1961, 12.
Tu, et al., "Cheap Nanocrystalline Soft Magnetic Alloy with HIgh Bs and Ultra-Low Iron Loss", Proceedings of the 7th China Conference on Functional Material and Applications, May 30, 2011, 257-264.
Xie, "Pharmaceutical Equipment Operation and Maintenance", Guangdong Higher Education Press, Feb. 28, 2015, 252-253.
English language translation of Chinese Office Action dated Jan. 7, 2020 issued in counterpart Chinese Application No. 201680037664.2.

* cited by examiner

METHOD FOR PRODUCING LAMINATED MAGNETIC CORE

TECHNICAL FIELD

This invention relates to a laminated magnetic core and a method for producing the same. In particular, the invention relates to a laminated magnetic core made of an Fe-based nanocrystalline alloy strip which is suitable for use in a magnetic core of a motor or the like, and a method for producing the same.

BACKGROUND ART

Patent Document 1 discloses a method for producing a core (magnetic core) using a strip (Fe-based amorphous strip) made of an Fe-based soft magnetic alloy. According to Patent Document 1, a heat treatment for forming nanocrystalline grains (bcc-Fe crystal grains) made of bcc-Fe is carried out twice or more separately, to either a strip or a core made by winding a strip so that an influence of self-heating in the heat treatment is reduced.

PRIOR ART DOCUMENTS

Patent Document(s)

Patent Document 1 JPA2003-213331

SUMMARY OF INVENTION

Technical Problem

An Fe—B—Si—P—Cu alloy with an appropriate composition ratio has high amorphous formability. Moreover, an Fe-based amorphous strip made of this alloy has excellent magnetic properties. Accordingly, it is expected that a magnetic core made by using such an Fe-based amorphous strip has excellent magnetic properties.

However, the Fe-based amorphous strip having such composition is easy to become brittle when bcc-Fe crystal grains form therein by carrying out a heat treatment. Hence, the strip after the heat treatment cracks or chips easily by processing the strip. For example, it is difficult to cut a strip after the heat treatment into a desired complicated shape in order to apply the strip after the heat treatment to a motor magnetic core having a complicated shape. On the other hand, when a heat treatment is carried out after stacking workpieces which are shaped from an Fe-based amorphous strip, it becomes difficult to heat the whole of a magnetic core uniformly as the magnetic core becomes large. Accordingly, there is a possibility that a homogeneous structure cannot be added to a magnetic core so that the magnetic core does not have sufficient magnetic properties.

Therefore, an object of the present invention is to provide a method for producing a laminated magnetic core having sufficient magnetic properties from a strip made of an Fe—B—Si—P—Cu—C alloy.

Solution to Problem

An aspect of the present invention provides a method for producing a laminated magnetic core. The method includes a shape-processing step of giving a shape to an amorphous strip; a heat-treating step of heating the amorphous strip after the shape-processing step; and a stacking step of stacking the amorphous strip after the heat-treating step. In the heat-treating step, the heating rate is 80° C. per second or more.

Moreover, another aspect of the present invention provides a method for producing a laminated magnetic core. The method includes a shape-processing step of giving a shape to an amorphous strip; a heat-treating step of heating the amorphous strip after the shape-processing step; and a stacking step of stacking the amorphous strip after the heat-treating step. In the heat-treating step, both surfaces of the amorphous strip are brought into contact with heaters so that the amorphous strip is heated.

Advantageous Effects of Invention

According to the present invention, a shape is given to strips before a heat treatment which makes the strips brittle. Therefore, a complicated shape such as a stator core of a motor can be formed with high accuracy. After that, the strips having the shape are subjected to a heat treatment before stacking. With this, temperature deviation decreases in the strips, and bcc-Fe crystal grains form homogeneously so that strips with uniform magnetic properties are obtained. Furthermore, the strips are stacked after the heat treatment so that a magnetic core having excellent magnetic properties is obtained.

In detail, when the heating rate is much higher than a conventional heating rate in the heat treatment, a strip having a homogeneous structure can be obtained. For example, when a strip is heated at a relatively low heating rate such as 100° C. per minute, crystal nuclei included in the strip prior to the heat treatment grow earlier into large crystal grains, and variation occurs in crystal grain size. In contrast, when the heating rate is high, new crystal nuclei form before fine crystals included in a strip prior to the heat treatment grow to large grains, and the crystal nuclei and the fine crystals grow together so that variation does not occur in crystal grain size eventually. Consequently, a strip having a homogeneous structure can be obtained. In addition, when the heating rate is high, producing time is short and productivity is high.

In particular, when the heating rate is 80° C. per second or more in the heat-treating step, homogeneous crystal grains can be obtained, and the mean grain size of crystal grains can be reduced. Here, a standard for being homogeneous is, for example, that each of the crystal grains has a grain size which is within a range of a mean grain diameter ±5 nm when the crystal grains are observed in an Fe-based nanocrystalline alloy strip obtained by the heat treatment. The Fe-based nanocrystalline alloy strip having such a structure with a small variation has good magnetic properties. Moreover, when a motor includes a laminated magnetic core obtained by stacking such Fe-based nanocrystalline alloy strips, the motor has a low iron loss and a high motor efficiency.

When the present invention is applied to an industrial product such as a motor, an amorphous strip to be subjected to a heat treatment has a relatively large size. It is relatively easy to control the heating rate when a small sized amorphous strip such as an experimental sample is subjected to a heat treatment. On the other hand, it is difficult to control the heating rate appropriately in a heat treatment for a large sized amorphous strip in general. However, when an amorphous strip is heated by substantially bringing both surfaces of the amorphous strip into contact with heaters, control such as an increase in heating rate can be appropriately carried out so that a strip having a desired homogeneous structure is obtained. Such a heating method, or direct contact heating for the amorphous strip using heaters, can facilitate heating control like the aforementioned control and is suitable for mass production. Additionally, though it is preferable that the amorphous strip and the heaters be arranged to be in direct contact, the strip may be supported by a support portion, which is sufficiently thin and has high thermal conductivity, to be heated through the support portion in a case of mass production.

DESCRIPTION OF EMBODIMENTS

Figure 1:
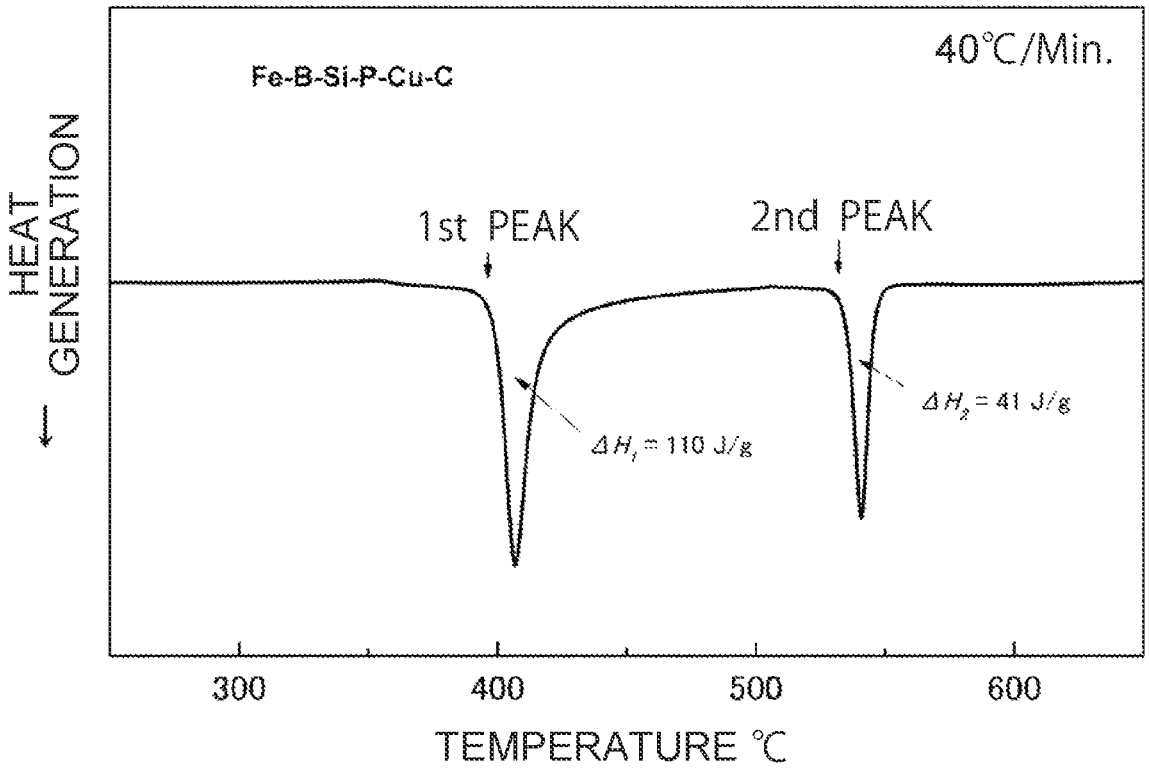
FIG. 1 is a graph showing a result of a differential scanning calorimetry (DSC), at a heating rate of 40° C./min, of an alloy composition according to an embodiment.

While the invention is susceptible of various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

An alloy composition according to an embodiment of the present invention is suitable for a starting material of an Fe-based nanocrystalline alloy and is of a composition formula of $Fe_aB_bSi_cP_xC_yCu_z$, where $79 \le a \le 86$ atomic %, $5 \le b \le 13$ atomic %, $0 < c \le 8$ atomic %, $1 \le x \le 8$ atomic %, $0 \le y \le 5$ atomic %, $0.4 \le z \le 1.4$ atomic % and $0.08 \le z/x \le 0.8$. 3 atomic % or less Fe may be replaced with one or more element selected from Ti, Zr, Hf, Nb, Ta, Mo, W, Cr, Co, Ni, Al, Mn, Ag, Zn, Sn, As, Sb, Bi, Y, N, O and rare-earth elements.

In the above alloy composition, Fe is a main element and an essential element to provide magnetism. It is basically preferable that an Fe content be high to improve a saturation magnetic flux density and to reduce material costs. When the Fe content is less than 79 atomic %, a desirable saturation magnetic flux density cannot be obtained. When the Fe content is more than 86 atomic %, it becomes difficult to form an amorphous phase under a melt-quenching condition so that crystal grains have various diameters or are coarsened. In other words, when the Fe content is more than 86 atomic %, a homogeneous nanocrystalline structure cannot be obtained so that the alloy composition has degraded soft magnetic properties. Accordingly, it is desirable that the Fe content be 79 atomic % or more and 86 atomic % or less. In particular, when the saturation magnetic flux density of 1.7 T or more is required, it is preferable that the Fe content be 81 atomic % or more.

In the above alloy composition, B is an essential element to form the amorphous phase. When a B content is less than 5 atomic %, it becomes difficult to form the amorphous phase under the melt-quenching condition. When the B content is more than 13 atomic %, ΔT is reduced, and the homogeneous nanocrystalline structure cannot be obtained so that the alloy composition has degraded soft magnetic properties. Accordingly, it is desirable that the B content be 5 atomic % or more and 13 atomic % or less. In particular, when the alloy composition is required to have its low melting point for mass-producing thereof, it is preferable that the B content be 10 atomic % or less.

In the above alloy composition, Si is an essential element to form an amorphous material and makes nanocrystals stable during nanocrystallization. When the alloy composition does not include Si, the amorphous formability is lowered, and the homogeneous nanocrystalline structure cannot be obtained so that the soft magnetic properties are degraded. When the Si content is more than 8 atomic %, the saturation magnetic flux density and the amorphous formability are lowered, and furthermore the soft magnetic properties are degraded. Accordingly, it is desirable that the Si content be 8 atomic % or less (excluding zero). In particular, when the Si content is 2 atomic % or more, the amorphous formability is improved so as to be capable of forming a continuous strip stably, and the ΔT increases so that homogeneous nanocrystals are obtained.

In the above alloy composition, P is an essential element to form the amorphous material. In the present embodiment, the amorphous formability and stability of the nanocrystals are improved by using a combination of B, Si and P in comparison with a case where only one element selected from B, Si and P is used. When the P content is less than 1 atomic %, it becomes difficult to form the amorphous phase under the melt-quenching condition. When the P content is more than 8 atomic %, the saturation magnetic flux density is lowered, and the soft magnetic properties are degraded. Accordingly, it is desirable that the P content be 1 atomic % or more and 8 atomic % or less. In particular, when the P content is 2 atomic % or more and 5 atomic % or less, the amorphous formability is improved, and a continuous strip can be formed stably.

In the above alloy composition, C is an element to form the amorphous material. In the present embodiment, the amorphous formability and the stability of the nanocrystals are improved by using a combination of B, Si, P and C in comparison with a case where only one element selected from B, Si, P and C is used. Because C is inexpensive, an increase in the amount of C reduces the amount of the other metalloids so that the total material cost decreases. However, there is a problem that when the C content becomes over 5 atomic %, the alloy composition becomes brittle, and the soft magnetic properties are degraded. Accordingly, it is desirable that the C content be 5 atomic % or less. In particular, when the C content is 3 atomic % or less, variation of the composition caused by partial evaporation of C from the molten alloy composition can be reduced.

In the above alloy composition, Cu is an essential element to be useful for nanocrystallization. It should be noted that Cu is basically expensive and, when the Fe content is 81 atomic % or more, Cu tends to make the alloy composition brittle or oxidizable. When the Cu content is less than 0.4 atomic %, the nanocrystallization becomes difficult. When the Cu content is more than 1.4 atomic %, precursors formed of the amorphous phase become so heterogeneous that a homogeneous nanocrystalline structure cannot be obtained by the formation of the Fe-based nano-crystallization alloy, and the soft magnetic properties are degraded. Accordingly, it is desirable that the Cu content be 0.4 atomic % or more and 1.4 atomic % or less. In particular, it is preferable that the Cu content be 1.1 atomic % or less, in consideration of the embrittlement and the oxidation of the alloy composition.

There is a strong affinity between a P atom and a Cu atom. Therefore, when the alloy composition includes P and Cu at a specific ratio between the elements, clusters each of which has a size of 10 nm or less are formed. Due to these nano-size clusters, bcc-Fe crystals come to have a fine structure even when the Fe-based nanocrystalline alloy forms. In the present embodiment, the specific ratio (z/x) of the Cu content (z) to the P content (x) is 0.08 or more and 0.8 or less. When the ratio is out of this range, the homogeneous nanocrystalline structure cannot be obtained, and the alloy composition cannot have superior soft magnetic properties consequently. It is preferable that the specific ratio (z/x) be 0.08 or more and 0.55 or less, in consideration of the embrittlement and the oxidation of the alloy composition.

The alloy composition according to the present embodiment has an amorphous phase as a primary phase and has a continuous strip shape with a thickness of from 15 to 40 μm. The alloy composition with the continuous strip shape may be formed by using a conventional apparatus such as a single roll casting apparatus or a double roll casting apparatus each of which is used to produce an Fe-based amorphous strip or the like.

The alloy composition according to the present embodiment is subjected to a heat treatment after a shape-processing step. The temperature in the heat treatment is higher than or equal to a crystallization temperature of the alloy composition according to the present embodiment. The crystallization temperatures can be evaluated, for example, by carrying out a thermal analysis using a DSC device at a heating rate of about 40° C./min. The volume fraction of the bcc-Fe crystals formed in the alloy composition is 50% or more after the heat treatment. The volume fraction can be evaluated from the change from a first peak area before the heat treatment to a first peak area after the heat treatment, the first peak area being obtained from a result of the DSC analysis shown in FIG. 1.

Figure 2:
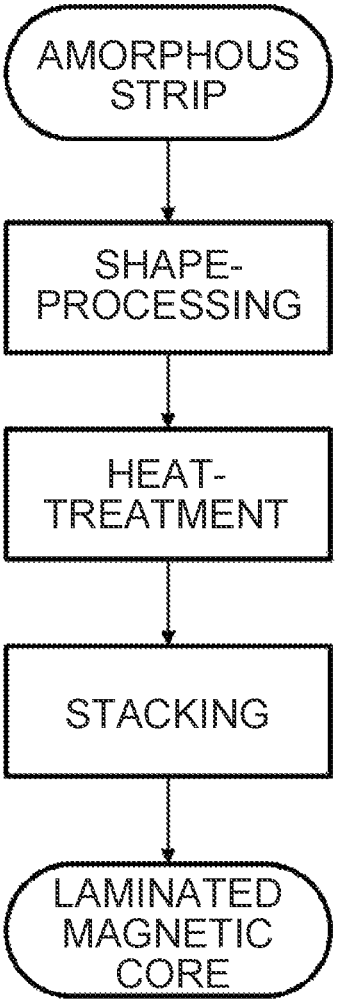
FIG. 2 is a flowchart schematically showing a method for producing a magnetic core according to an embodiment of the present invention.

It is known that an amorphous strip becomes brittle when the amorphous strip is subjected to a heat treatment. Accordingly, it is hard to process the strip into a magnetic core shape after a heat treatment. Therefore, in the present embodiment, the heat treatment is carried out after shape processing. In detail, as shown in FIG. 2, an amorphous strip is first produced in an amorphous strip step in a method for producing a magnetic core according to the present embodiment. Secondly, a shape is given to the amorphous strip in a shape-processing step. Next, the amorphous strip having the shape is subjected to a heat treatment in a heat-treating step. In this manner, the Fe-based nanocrystalline alloy strip having the shape is obtained. Then, a plurality of the strips after the heat treatment, i.e. a plurality of the Fe-based nanocrystalline alloy strips each of which has a shape, are stacked in a stacking step to obtain a laminated magnetic core.

Hereinafter, the heat-treating step mentioned above will be described in detail. The heat-treating method for the alloy composition according to the present embodiment defines a heating rate and lower and upper limits of heat treatment temperature.

The alloy composition having a shape according to the present embodiment is subjected to a heat treatment which includes heating, holding and cooling in this order. In the heating stage for heating the alloy composition according to the present embodiment, the heating rate is determined to be 80° C. per second or more. When the heating rate is such a high rate, the structure of a Fe-based nanocrystalline alloy strip obtained by the heat treatment is homogeneous. When the heating rate is less than 80° C. per second, a mean crystal grain diameter in a bcc-Fe phase (a phase of Fe having a bcc structure) becomes over 20 nm. In the heating rate, the coercive force of a magnetic core eventually obtained is over 10 A/m, and soft magnetic properties suitable for the magnetic core are degraded.

Figure 3:
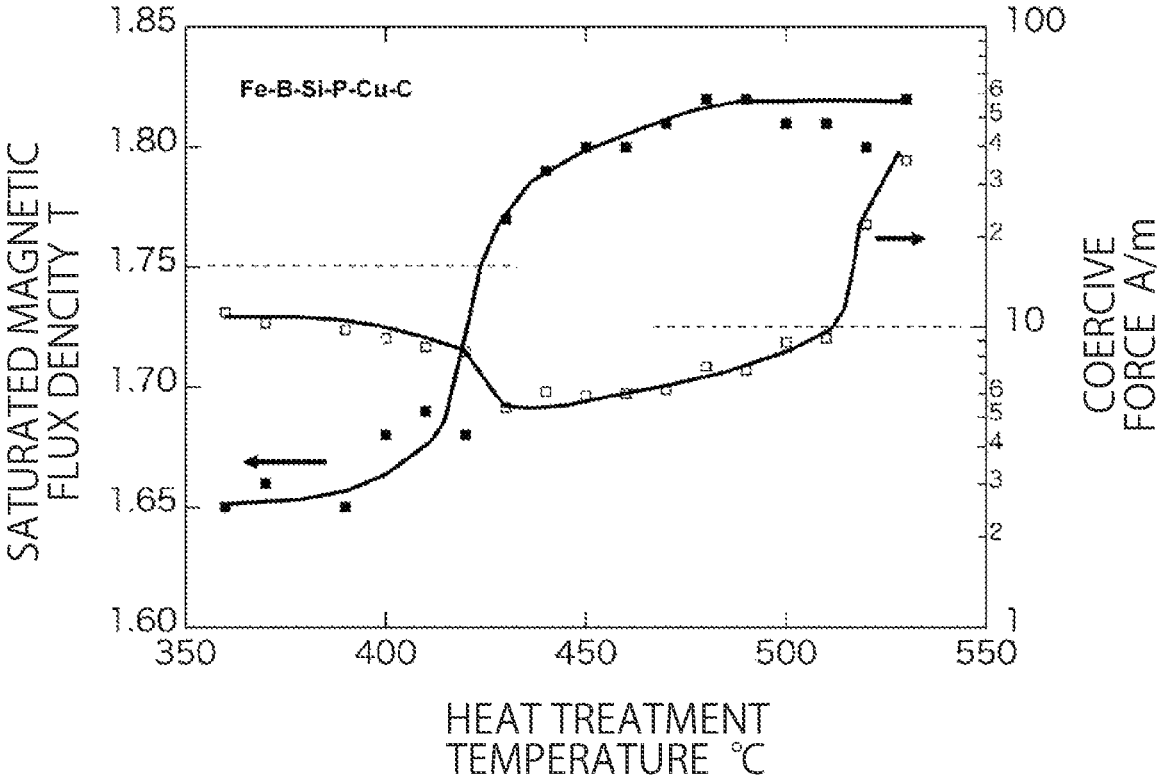
FIG. 3 is a graph schematically showing a temperature change of a strip in a heat-treating step according to an embodiment and changes of a saturation magnetic flux density and a coercive force in accordance with the temperature change.

FIG. 3 is a graph schematically showing a temperature change of a strip in the heat-treating step according to the present embodiment and changes of a saturation magnetic flux density and a coercive force in accordance with the temperature change. The lower limit of the heat treatment temperature for the alloy composition is determined to be the crystallization temperature or more and 430° C. or more. When the heat treatment temperature is less than 430° C., the volume fraction of the formed bcc-Fe crystals becomes less than 50%. The saturation magnetic flux density of the magnetic core eventually obtained does not reach 1.75 T as shown in FIG. 3. When the saturation magnetic flux density is 1.75 T or less, power as the magnetic core is low so that motors to which the magnetic core is applicable are restricted.

The upper limit of the heat treatment temperature for the alloy composition according to the present embodiment is determined to be 500° C. or less. When the heat treatment temperature is over 500° C., it is impossible to prevent the bcc-Fe phase from forming rapidly so that the heat generation during crystallization causes thermal runaway. In the heat treatment temperature, the coercive force of the magnetic core eventually obtained becomes over 10 A/m as shown in FIG. 3.

An isothermal holding time for the alloy composition according to the present embodiment depends on the heat treatment temperature and is preferably from 3 seconds to 5 minutes. Furthermore, the cooling rate to be used is preferably about 80° C. per second obtained by furnace cooling. However, the present invention is not limited to the isothermal holding time and cooling rate.

As an atmosphere in the heat treatment for the alloy composition according to the present embodiment, air, nitrogen or inert gas is conceivable, for example. However, the present invention is not limited to the atmospheres. In particular, when the strip is subjected to a heat treatment in the air, the strip after the heat treatment, or the Fe-based nanocrystalline alloy strip, loses a metallic luster which the Fe-based amorphous strip before the heat treatment has. Both of front and back surfaces of the strip change color in comparison with those before the heat treatment. This is probably because oxide films are formed on the surfaces. When a strip is subjected to the heat treatment under the above appropriate conditions and then is seen with the naked eye, the color of the strip is in a range from brown to blue or purple. Moreover, the color of the front surface is slightly different from the color of the back surface. This is probably because there is a difference in surface state between the surfaces of the strip. Thus, when the strip is subjected to a heat treatment in an atmosphere including oxygen, e.g. the air, the visually identifiable oxide films form on the front and the back surfaces of the Fe-based nanocrystalline alloy strip obtained by the heat treatment. Furthermore, in a case of over 500° C., the color of the strip becomes white or ash gray. This is probably because the oxide films form excessively by the thermal runaway caused by the heat generation during crystallization.

When the oxide film is actively formed on the both surfaces of the Fe-based nanocrystalline alloy strip, the surface resistance of the Fe-based nanocrystalline alloy strip becomes large. When the Fe-based nanocrystalline alloy strips each of which has a large surface resistance are stacked, the interlayer insulation between the strips becomes high so that eddy current loss becomes small. As a result, a motor as a final product is improved in efficiency.

In terms of production, due to the above oxidation, it is possible to judge whether the crystallization state of the strip is good or bad visually and simply (by a nondestructive method). For example, when the color is pale or the metallic luster is remained, it can be judged that the temperature is low.

As a concrete heating method in the heat treatment for the alloy composition according to the present embodiment, it is preferable to bring the strip into contact with a heat transfer solid, such as a heater, having enough heat capacity, for example. In particular, it is preferable to heat the Fe-based amorphous strip by bringing the heat transfer solids into contact with the both surfaces of the Fe-based amorphous strip to sandwich the Fe-based amorphous strip with the heat transfer solids. According to a heating method like this, the appropriate temperature control can be easily achieved when a large sized amorphous strip such as an amorphous strip for an industrial product is heated. However, the present invention is not limited to the heating methods. As long as an appropriate temperature control is possible during heating, another heat treatment method, such as a noncontact heating using infrared rays or high frequency, for example, may be adopted as a concrete heating method.

[Heat Treatment Apparatus]

Referring to a schematic drawing of an apparatus which embodies the heat-treating method for the alloy composition according to the present embodiment, a procedure of the heat-treating step will be described.

Figure 4:
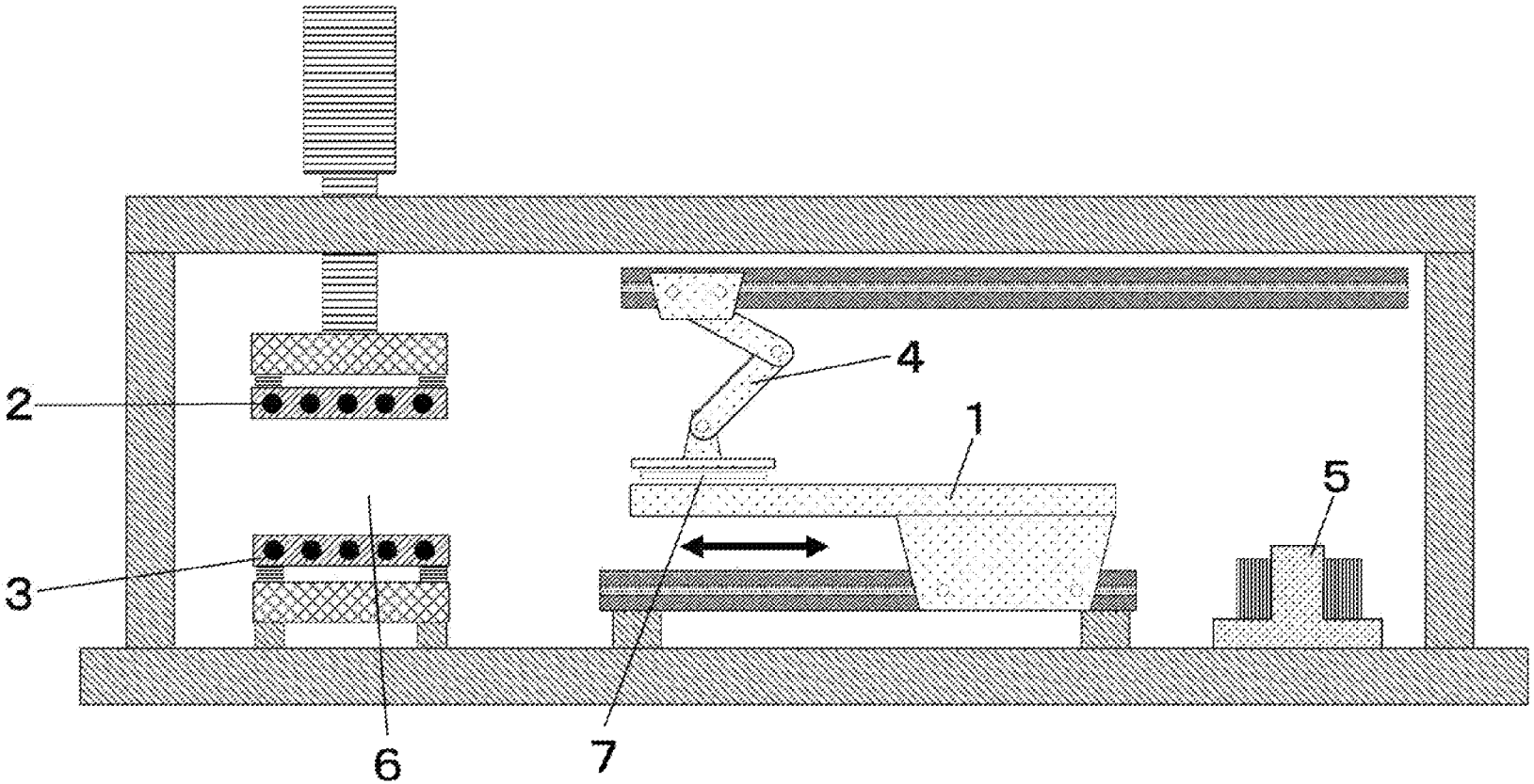
FIG. 4 is a schematic structural drawing of an apparatus made to embody a producing method of the present invention.

FIG. 4 is a schematic structural drawing of the apparatus made to embody the producing method of the present invention. A shape is given to a strip 7 in advance, and the strip 7 is moved to a heating section 6 by a transfer mechanism 1.

The heating section 6 of the present embodiment is provided with an upper heater 2 and a lower heater 3. The upper heater 2 and the lower heater 3 are previously heated up to a desired temperature, and the strip 7 is sandwiched between the upper heater 2 and the lower heater 3 and thereby is heated when the strip 7 moves to a predetermined position. That is, in the present embodiment, the strip 7 is heated in a state that both surfaces of the strip 7 are in contact with the heaters. In this event, the heating rate is determined by a ratio of the heat capacity of the strip 7 and the heat capacity of the upper heater 2 and the lower heater 3. After the strip 7 is sandwiched between the upper heater 2 and the lower heater 3 and is heated at a desired heating rate, the temperature of the strip 7 is kept as it is for a predetermined time. After that, the strip 7 is taken out by an eject mechanism 4 to be automatically stacked in a stacker 5 provided separately. When a series of the operations are repeated, strips having uniform prescribed magnetic properties can be obtained after the heat treatment.

In particular, because the heat treatment, heating and cooling are carried out in the state that the strip 7 is sandwiched between the upper heater 2 and the lower heater 3, a rapid heating and rapid cooling can be carried out. Specifically, the heating rate can be set to 80° C. per second or more. As mentioned above, when the heating rate increases, the strip with a little variation of crystal grain sizes can be obtained, and the productivity is improved by decreasing the production time. In particular, because the strip is brought into contact with the heaters in the apparatus, the appropriate heating control can be easily carried out. In the transfer mechanism 1 shown in FIG. 4, a supporting portion supporting the strip 7 (a portion on which the strip 7 is placed) is drawn to have a thickness. However, upon implementation, the supporting portion is thin enough not to hinder heating the strip, and is made of a material with a high heat transfer rate. The strip 7 is heated by sandwiching the strip 7 and the supporting portion between the upper heater 2 and the lower heater 3.

The magnetic core, which is preferably produced as mentioned above, according to the present embodiment includes a bcc-Fe phase having a mean crystal grain diameter of 20 nm or less, preferably 17 nm or less, and has a high saturation magnetic flux density of 1.75 T or more and a low coercive force of 10 A/m or less.

EXAMPLES

Hereinafter, referring to a plurality of examples and a plurality of comparative examples, the embodiment of the present invention will be described in more detail.

Examples 1-8 and Comparative Examples 1-12

At first, materials of Fe, Si, B, P, Cu and C were weighed to obtain an alloy composition of $Fe_{84.3}Si_{0.5}B_{9.4}P_4Cu_{0.8}C_1$ and were melted in a melting process using high frequency induction heating. After that, the molten alloy composition was processed in the air by a single roll casting method to produce strip-like alloy compositions each of which had a thickness of about 25 μm. Each of these strip-like alloy compositions was cut to have a width of 10 mm and a length of 50 mm (shape-processing step), and a phase thereof was identified by X-ray diffraction method. Each of these processed strip-like alloy compositions had an amorphous phase as a primary phase. Next, under heat treatment conditions listed on Table 1 and under conditions of Examples 1-8 and Comparative Examples 1-12, the compositions were subjected to the heat treatment by using the apparatus shown in FIG. 4 (heat-treating step). Each of the strip-like alloy compositions was evaluated by a thermal analysis using a DSC device at a heating rate of about 40° C./min before and after the heat treatment, and the volume fraction of formed bcc-Fe crystals was calculated on the basis of a first peak area ratio obtained thereby. Furthermore, a saturation magnetic flux density (Bs) of each of the strip-like alloy compositions after the shape-processing step and the heat-treating step was measured in a magnetic field of 800 kA/m by using a vibrating sample magnetometer (VMS). A coercive force (Hc) of each of the alloy compositions was measured in a magnetic field of 2 kA/m by using a direct current BH tracer. Measurement results are also shown in Table 1.

TABLE 1

| | Alloy Composition | | Heat-treatment Condition | | | Structure of bcc-Fe Phase | | Magnetic Properties | |
|---|---|---|---|---|---|---|---|---|---|
| | Thickness (μm) | Primary Phase | Heating Rate (° C./sec) | Heat-Treatment Temperature (° C.) | Holding Time (sec) | Volume Fraction (%) | Mean Grain Diameter (nm) | Bs (T) | Hc (A/m) |
| Example 1 | 27 | Amo | 120 | 460 | 60 | 71.4 | 17 | 1.81 | 7.5 |
| Example 2 | 32 | Amo | 250 | 470 | 60 | 72.6 | 17 | 1.81 | 6.2 |
| Example 3 | 36 | Amo | 135 | 470 | 65 | 73.3 | 18 | 1.80 | 7.9 |
| Example 4 | 29 | Amo | 170 | 470 | 60 | 73.1 | 17 | 1.81 | 6.8 |
| Example 5 | 41 | Amo | 85 | 460 | 62 | 72.7 | 16 | 1.80 | 7.4 |
| Example 6 | 35 | Amo | 105 | 435 | 60 | 70.9 | 17 | 1.78 | 5.4 |
| Example 7 | 32 | Amo | 140 | 430 | 60 | 70.2 | 19 | 1.77 | 5.8 |
| Example 8 | 38 | Amo | 185 | 450 | 55 | 72.8 | 20 | 1.80 | 7.7 |
| Comparative Example 1 | 52 | Amo + bcc-Fe | 155 | 470 | 50 | 71.7 | 32 | 1.79 | 22 |
| Comparative Example 2 | 49 | Amo + bcc-Fe | 160 | 450 | 70 | 72.0 | 28 | 1.80 | 30 |
| Comparative Example 3 | 32 | Amo | 75 | 455 | 55 | 57.2 | 26 | 1.77 | 33 |
| Comparative Example 4 | 36 | Amo | 60 | 460 | 55 | 60.7 | 28 | 1.78 | 36 |
| Comparative Example 5 | 32 | Amo | 120 | 410 | 50 | 39.9 | 18 | 1.70 | 8.9 |
| Comparative Example 6 | 32 | Amo | 120 | 410 | 120 | 44.1 | 21 | 1.73 | 9.2 |
| Comparative Example 7 | 32 | Amo | 120 | 425 | 55 | 43.9 | 17 | 1.72 | 7.6 |
| Comparative Example 8 | 32 | Amo | 120 | 425 | 100 | 45.0 | 20 | 1.73 | 12 |
| Comparative Example 9 | 36 | Amo | 120 | 410 | 50 | 40.6 | 19 | 1.69 | 9.0 |
| Comparative Example 10 | 36 | Amo | 120 | 410 | 120 | 44.2 | 22 | 1.72 | 9.2 |
| Comparative Example 11 | 36 | Amo | 120 | 425 | 55 | 42.7 | 19 | 1.70 | 8.0 |
| Comparative Example 12 | 36 | Amo | 120 | 425 | 100 | 45.2 | 21 | 1.72 | 9.9 |
| Comparative Example 13 | 32 | Amo | 120 | 505 | 20 | 75.2 | 31 | 1.82 | 45 |
| Comparative Example 14 | 32 | Amo | 120 | 510 | 20 | 76.6 | 35 | 1.80 | 56 |

As can be understood from Table 1, each of the strip-like alloy compositions of Examples had an amorphous material as the primary phase. In the structure of all samples obtained after the heat treatment in the producing method of the present invention, the volume fraction of a bcc-Fe phase was 50% or more and the mean grain diameter of the bcc-Fe phase was 20 nm or less. Moreover, the grain diameters of observed crystal grains were within a range of a mean grain diameter ±5 nm. As a result of obtaining a desired structure like this, each Example showed a high saturation magnetic flux density of 1.75 T or more and a low coercive force of 10 Nm or less.

The strip-like alloy composition of each of Comparative Examples 1 and 2 was thick and had a structure of mixed phases of an amorphous phase and a bcc-Fe phase as a primary phase. When each composition was subjected to a heat treatment in the producing method of the present invention, a mean grain diameter of a formed bcc-Fe phase was over 21 nm. As a result, the coercive force was degraded to over 10 Nm.

The strip-like alloy composition of each of Comparative Examples 3 and 4 was subjected to the heat treatment at a heating rate lower than a heating rate defined in the producing method of the present invention. In consequence, the mean grain diameter of the formed bcc-Fe phase was over 21 nm. As a result, the coercive force was degraded to over 10 A/m.

Comparative Examples 5-12 are shown as examples each of which used the same strip-like alloy composition as Example 2 or 3 and was applied to a heat treatment at a heat treatment temperature lower than or equal to the heat treatment temperature defined in the producing method of the present invention. In each of Comparative Examples, the volume fraction of the formed bcc-Fe phase was less than 50%. As a result, the saturation magnetic flux density was less than 1.75 T. This is probably because that the heat treatment temperature was low so that the formation of the bcc-Fe phase became less. The volume fraction of the formed bcc-Fe phase may be 50% or more, preferably 70% or more.

Similarly, Comparative Examples 13 and 14 are shown as examples each of which used the same strip-like alloy composition as Example 2 and was applied to a heat treatment over the temperature defined in the producing method of the present invention. In consequence, the mean grain diameter of the formed bcc-Fe phase was over 30 nm. As a result, the coercive force was remarkably degraded to over 45 A/m.

Example 9 and Comparative Examples 15 and 16

The strip-like alloy composition processed into a practical shape for a motor magnetic core was subjected to a heat treatment under condition of Example 2 or Comparative Example 3 by using the apparatus shown in FIG. 4 and made under condition defined in the present invention. In accordance with the flowchart of the producing method of FIG. 2, the strip-like alloy composition having the practical shape were stacked.

Figure 5:
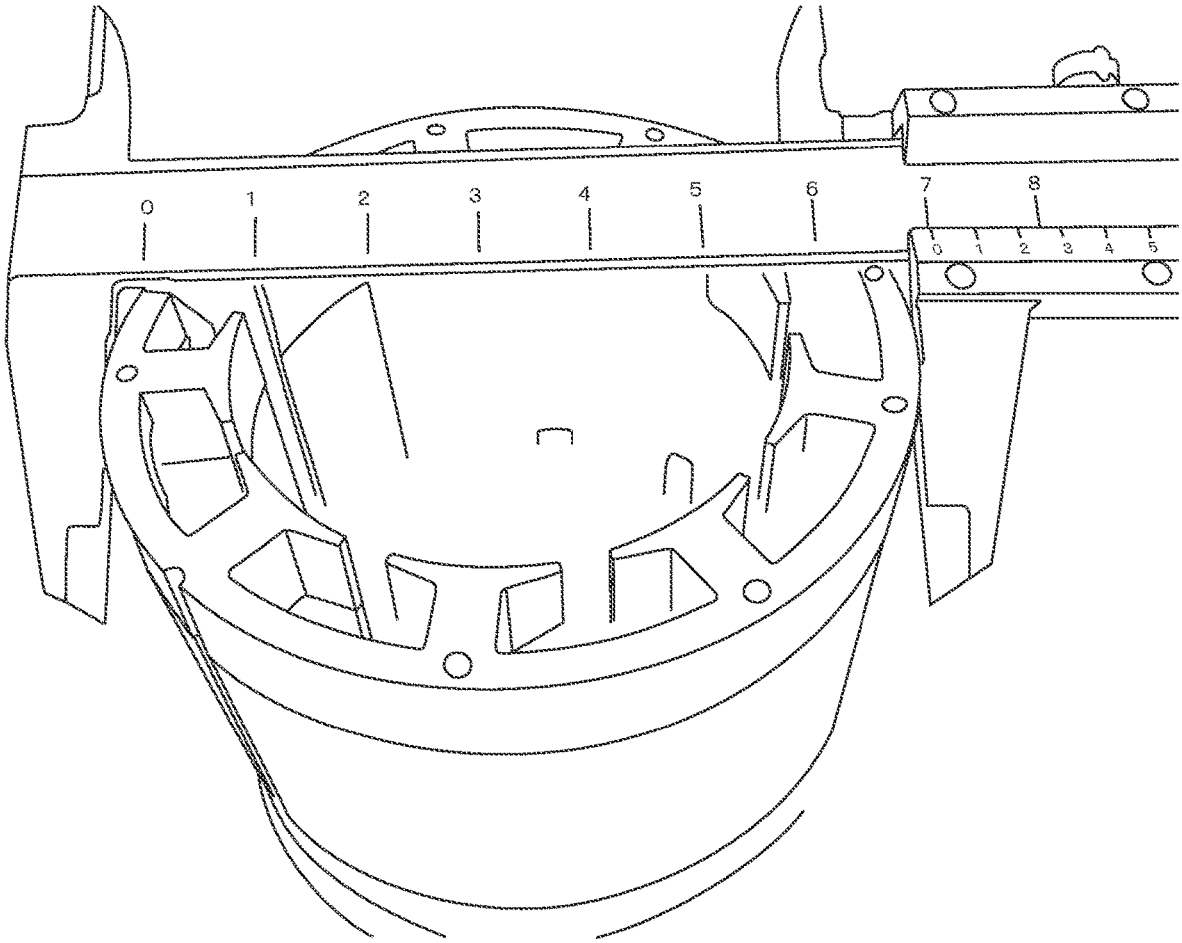
FIG. 5 is an external view of laminations of a motor magnetic core produced in an example of the present invention.

FIG. 5 is an external view of laminations of a motor magnetic core produced in an example of the present invention. End plates for temporal fixing were on the top and the bottom of the motor magnetic core, and strips, each of which was a magnetic core material after a heat treatment, were stacked between the end plates. The outer diameter of the motor magnetic core was 70 mm. The stacked strips were attached on a fixing part, and a wire was wound on predefined positions of portions protruding inward to produce a stator. The performance of stators was evaluated using different magnetic core materials. Alloy compositions used in the magnetic cores and motor performance are shown in Table 2.

TABLE 2

| | Alloy Composition | Core Loss (W) | Motor Efficiency (%) |
|---|---|---|---|
| Example 9 | Strip of Example 2 | 0.4 | 91 |
| Comparative Example 15 | Strip of Comparative Example 3 | 1.0 | 86 |
| Comparative Example 16 | Commercial Electrical Steel Plate | 1.4 | 85 |

As can be understood from Table 2, the motor of Example 9 which used, as the magnetic core, a strip-like alloy composition obtained by the heat treatment under the condition of Example 2 showed a low iron loss of 0.4 W and a high motor efficiency of 91% in comparison with motors using other materials.

The present invention is based on a Japanese patent application No. 2015-134309 filed with the Japan Patent Office on Jul. 3, 2015, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

1 Transfer Mechanism
2 Upper Heater
3 Lower Heater
4 Eject Mechanism
5 Stacker
6 Heating Section
7 Strip

The invention claimed is:

1. A method for producing a laminated magnetic core, the method comprising:
giving a shape to a plurality of amorphous strips;
carrying out a heat treatment including heating each of the amorphous strips having the shape at a heating rate of at least 80° C. per second;
stacking strips of an alloyed composition obtained from the heat treatment of the amorphous strips; and
judging whether each of the strips of the alloyed composition is good or bad according to a color of the strip of the alloyed composition,
wherein the color is of an oxide film formed on the strip of the alloyed composition by the heat treatment.

2. The method according to claim 1, wherein each of the amorphous strips is subjected to the heat treatment at a temperature higher than a crystallization temperature of the amorphous strip.

3. The method according to claim 1, wherein, in each of the amorphous strips, bcc-Fe crystals increase by at least 50 volume % after the heat treatment.

4. The method according to claim 1, wherein, in each of the amorphous strips, bcc-Fe crystals increase by at least 70 volume % after the heat treatment.

5. The method according to claim 1, wherein the heat treatment includes keeping each of the amorphous strips in air.

6. The method according to claim 1, wherein the heating rate is at least 105° C. per second and at most 250° C. per second in the heat treatment.

7. The method according to claim 1, wherein each of the amorphous strips has a thickness of at least 15 μm and at most 41 μm.

8. The method according to claim 1, wherein each of the amorphous strips has a thickness of at least 32 μm and at most 41 μm.

9. The method according to claim 1, wherein each of the amorphous strips is of a composition formula of $Fe_aB_bSi_cP_xC_yCu_z$, where:
$81 \le a \le 86$ atomic %,
$5 \le b \le 10$ atomic %,
$2 \le c \le 8$ atomic %,
$1 \le x \le 5$ atomic %,
$0 \le y \le 3$ atomic %,
$0.4 \le z \le 1.1$ atomic % and
$0.08 \le z/x \le 0.55$.

10. The method according to claim 1, wherein the heat treatment comprises heating each of the amorphous strips having the shape by making contact of both surfaces of the amorphous strip with heaters.

11. The method according to claim 10, wherein each of the amorphous strips is heated by being sandwiched between an upper heater and a lower heater in the heat treatment.

12. The method according to claim 11, wherein the upper heater and the lower heater are heated before the amorphous strip is sandwiched between the upper heater and the lower heater.

13. The method according to claim 10, wherein each of two surfaces of each of the amorphous strips loses a metallic luster to be changed in color after the heat treatment.

14. The method according to claim 1, wherein the color having metallic luster shows that the heat treatment is insufficient and that the strip of the alloyed composition is bad.

15. A method for producing a laminated magnetic core, the method comprising:
giving a shape to a plurality of amorphous strips;
carrying out a heat treatment including heating each of the amorphous strips having the shape at a heating rate of at least 80° C. per second;
stacking strips of an alloyed composition obtained from the heat treatment of the amorphous strips; and
judging whether each of the strips of the alloyed composition is good or bad according to a color of the strip of the alloyed composition,
wherein each of the amorphous strips is of a composition formula of $Fe_aB_bSi_cM_dP_xC_yCu_z$, where:
$a \ge 79$ atomic %,
$5 \le b \le 13$ atomic %,
$0 < c \le 8$ atomic %,
$0 < d \le 3$ atomic %,
$a+d \le 86$ atomic %,
$1 \le x \le 8$ atomic %,
$0 \le y \le 5$ atomic %,
$0.4 \le z \le 1.4$ atomic %,
$0.08 \le z/x \le 0.8$, and
M is at least one element selected from the group consisting of Ti, Zr, Hf, Nb, Ta, Mo, W, Cr, Co, Ni, Al, Mn, Ag, Zn, As, Sb, Bi, Y, N, O and rare-earth elements.

16. A method for producing a laminated magnetic core, the method comprising:
giving a shape to a plurality of amorphous strips;
carrying out a heat treatment including heating each of the amorphous strips having the shape at a heating rate of at least 80° C. per second;

stacking strips of an alloyed composition obtained from the heat treatment of the amorphous strips; and judging whether each of the strips of the alloyed composition is good or bad according to a color of the strip of the alloyed composition, wherein the heat treatment includes keeping each of the amorphous strips in a range of at least 430° C. and at most 500° C. for at least 3 seconds and at most 5 minutes.

17. A method for producing a laminated magnetic core, the method comprising:

giving a shape to a plurality of amorphous strips;

carrying out a heat treatment including heating each of the amorphous strips having the shape at a heating rate of at least 80° C. per second;

stacking strips of an alloyed composition obtained from the heat treatment of the amorphous strips; and judging whether each of the strips of the alloyed composition is good or bad according to a color of the strip of the alloyed composition, wherein the color being in a range from brown to blue or purple indicates that the strip of the alloyed composition is good.

18. A method for producing a laminated magnetic core, the method comprising:

giving a shape to a plurality of amorphous strips;

carrying out a heat treatment including heating each of the amorphous strips having the shape at a heating rate of at least 80° C. per second;

stacking strips of an alloyed composition obtained from the heat treatment of the amorphous strips; and judging whether each of the strips of the alloyed composition is good or bad according to a color of the strip of the alloyed composition, wherein the color being white or ash gray indicates that the strip of the alloyed composition is bad.

19. A method for producing a laminated magnetic core, the method comprising:

giving a shape to a plurality of amorphous strips;

carrying out a heat treatment including heating each of the amorphous strips having the shape at a heating rate of at least 80° C. per second; and stacking strips of an alloyed composition obtained from the heat treatment of the amorphous strips;

wherein each of the amorphous strips is of a composition formula of $Fe_aB_bSi_cM_dP_xC_yCu_z$, where:

$a \geq 79$ atomic %, $5 \leq b \leq 13$ atomic %, $0 < c \leq 8$ atomic %, $0 < d \leq 3$ atomic %, $a+d \leq 86$ atomic %, $1 \leq x \leq 8$ atomic %, $0 \leq y \leq 5$ atomic %, $0.4 \leq z \leq 1.4$ atomic %, $0.08 \leq z/x \leq 0.8$, and M is at least one element selected from the group consisting of Ti, Zr, Hf, Nb, Ta, Mo, W, Cr, Co, Ni, Al, Mn, Ag, Zn, As, Sb, Bi, Y, N, O and rare-earth elements.

20. The method according to claim 19, wherein the heating rate is at most 250° C. per second.

21. The method according to claim 19, wherein the heating rate is at least 105° C. per second.

22. The method according to claim 21, wherein the heating rate is at most 250° C. per second.

* * * * *